US006375491B1

(12) United States Patent
Durand et al.

(10) Patent No.: US 6,375,491 B1
(45) Date of Patent: Apr. 23, 2002

(54) DEVICE FOR CONNECTING A MULTIPAIR CABLE WITH REDUCED CROSSTALK BETWEEN PAIRS

(75) Inventors: Francois Durand, Mt St Aignan; Didier Lecomte, Cavaillon; Bertrand Joly, Sevres, all of (FR)

(73) Assignee: Nexans, Paris (FR)

( * ) Notice: Subject to any disclaimer, the term of this patent is extended or adjusted under 35 U.S.C. 154(b) by 0 days.

(21) Appl. No.: 09/637,612

(22) Filed: Aug. 11, 2000

(30) Foreign Application Priority Data

Aug. 30, 1999 (FR) ..... 99 10907

(51) Int. Cl.[7] ..... H01R 4/24
(52) U.S. Cl. ..... 439/418; 439/941; 439/676
(58) Field of Search ..... 439/418, 941, 439/676, 460, 344, 610

(56) References Cited

U.S. PATENT DOCUMENTS 4,767,355 A * 8/1988 Phillipson et al. ..... 439/425
5,350,324 A * 9/1994 Guilbert ..... 439/894
5,556,307 A * 9/1996 Johnston ..... 439/676
5,601,447 A * 2/1997 Reed et al. ..... 439/404
5,888,100 A * 3/1999 Bofill et al. ..... 439/676

FOREIGN PATENT DOCUMENTS

EP 0 735 612 A1 10/1996
EP 0 932 225 A1 7/1999
WO WO 97/39499 10/1997

* cited by examiner

*Primary Examiner*—P. Austin Bradley
*Assistant Examiner*—Ross Gushi
(74) *Attorney, Agent, or Firm*—Sughrue Mion, PLLC

(57) ABSTRACT

The low crosstalk device for connecting a multipair cable includes, on a stripped end part of the cable, rear support means provided with channels for retaining insulated wires of the pairs, front support means for guiding the wires to be connected to contacts and an intermediate part in which the wires cross over. The channels are in lengthwise lateral communication with one another to define a passage in which all of the insulated wires are gripped tightly together in a layer, near the sheathed cable, and are advantageously provided in a block which is held in position relative to the front support means. Application: male RJ45 connectors, cross-connection connectors, terminal strips.

13 Claims, 3 Drawing Sheets

DEVICE FOR CONNECTING A MULTIPAIR CABLE WITH REDUCED CROSSTALK BETWEEN PAIRS

The present invention relates to connection devices which are connected to the pairs of a multipair cable for transmitting high-frequency signals and which include means for compensating crosstalk between the pairs to be connected and other pairs.

BACKGROUND OF THE INVENTION

Connection devices of the above kind include contact members which are arranged side by side in a row and to which the insulated wires of the pairs of the cable are connected. To connect them to the contact members, the pairs of insulated wires are exposed by stripping the sheath from the end part of the cable and untwisted. The proximity and parallel relationship of the various pairs of insulated wires in the end part of the cable when the sheath has been removed and they have been untwisted, and the proximity of the contact members in the row, give rise to problems of crosstalk between adjacent pairs which limit the frequencies that can be used for transmission over the pairs.

The document DE-C1-196 49 668 discloses a male connector of the above kind fitted to a cable with four individually screened pairs.

The connector has a row of eight adjacent contact members and a flat wiring support for the pairs and the insulated wires of the pairs. The wiring support has a rear part for holding the pairs, a front part for guiding or connecting the insulated wires and an intermediate or crossover part.

The intermediate part carries separators which divide it into four parallel channels. The end pairs of insulated wires received on it are each guided in one of the end channels and are screened practically as far as the front connecting part. The two insulated wires of each pair that has been removed from its screen are connected to two contact members at one end of the row. The two middle pairs that are received on the intermediate part are then freed from their individual screens. Their insulated wires are guided in the two channels and cross over so that each of the two middle channels contains two insulated wires each belonging to one of the two middle pairs, which provides coupling compensation along the middle channels. The insulated wires terminate in the connection part, where they are connected to the four middle contact members of the row in a required order that is different from their original order.

The above connector is relatively complex. It exploits the features of the screened pair cable to which it is fitted, but a screened-pair cable is very costly compared to a cable with unscreened pairs. Mounting the connector on a screened-pair cable is difficult and takes a particularly long time.

The document U.S. Pat. No. 5 556 307 discloses a female connection device fitted to the end of a multipair cable. The female connection device comprises a female connector at the front and a module at the rear for compensating coupling between pairs in the female connector at the front.

The female connector contains a row of curved flexible conductive inserts which are accessible through a front opening, into which a complementary male connector is plugged, and retained in a rear part of the female connector. It also includes a row of flat insulation displacement contacts with first ends connected to the conductive inserts in the rear part of the female connector and second ends projecting out of that rear part.

The coupling compensator module at the rear is mounted directly on the cable and is clipped to the rear part of the female connector. It comprises two similar parts which are fastened together and between which are defined, in succession, a rear cable entry and cable retainer, a rear row of channels for separating the insulated wires of the various pairs of the cable and keeping them flat, a cavity in which the insulated wires cross over and a front row of channels for guiding the wires and connecting them to the insulation-displacement contacts. The connecting channels are slotted at each end of their length for inserting insulation displacement contacts and the rear module clips onto the front female connector. The channels of the rear row, and therefore the insulated wires present in them, on the upstream side of the crossover cavity, are of particular length in order to compensate coupling between the parallel transmission paths defined downstream of the crossovers by the insulation displacement contacts and the conductive inserts of the female connector, which are connected to one another and to the pairs of the cable.

The above female connection device uses very short conductive inserts in the front female connector part, which reduces commensurately the coupling to be compensated. However, it uses insulation displacement contacts for connecting the pairs of insulated wires to the conductive inserts. The insulation displacement contacts, which are parallel to one another and face-to-face in their row, considerably increase the coupling to be compensated in said rear row of channels and limit the accuracy of the balancing that the compensation to be applied seeks to achieve. It further produces areas in which the characteristic impedance of the pairs is subject to a sharp discontinuity, which combines with a sharp discontinuity in the characteristic impedance caused by the conductive inserts and due to the separation of the insulated wires of the pairs along the compensator module and the predetermined but relatively great length required for the rear row of channels. What is more, the insulation displacement contacts are connected to the insulated wires in the connection channels of the coupling compensator module parallel to the insulated wires, which requires a very high insertion force, makes it somewhat difficult to clip the rear module to the front female connector, and entails the risk of the insulated wires slipping in the connecting channels and/or incorrect connection of the wires to the insulation displacement contacts. This method of connecting insulation displacement contacts to the insulated wires rules out the use of multistrand insulated wires.

OBJECT AND SUMMARY OF THE INVENTION

The object of the present invention is to overcome the drawbacks of the aforementioned prior art connection devices, to improve crosstalk compensation and to reduce harmful effects.

The invention provides a low crosstalk connection device for a multipair cable, the device comprising a stripped end part of said cable, an insulative body, a row of first contacts mounted in said body, rear support means along said stripped end part of said cable including a row of parallel channels of particular length for retaining insulated wires of said pairs, front support means for guiding said wires, at the same pitch as said contacts and in a particular order different from that of said wires in said channels, for connecting said wires to said first contacts, and an intermediate part in which the insulated wires of said pairs cross over, wherein said channels are in lateral communication with one another along their length and define a peripherally closed passage for tightly gripping all of said insulated wires in contact with one another in a layer, near the end of the sheath of said cable, and wherein said front support means include a path for transversely connecting said wires to said first contacts.

Advantageously:

The rear support means comprise a block through which said channels pass and which is held in position relative to said front support means.

The intermediate part between said front and rear parts for holding the crossing over wires fixed in position thereon is of limited length.

Said front and rear support means and said intermediate part are each less than 5 mm long.

Said front and rear support means form a common support equipped with said block and integrating said intermediate part in which said insulated wires cross over.

Said device constitutes a male RJ45 connector and said support is mounted in said insulative body constituting the connector body.

Said device is a terminal strip in which said insulative body is that of said terminal strip and one face of said insulative body of which constitutes said intermediate part and said front support means and holds said block in position on it.

Said device is a first cross-connection connector in which said insulative body is that of said first cross-connection connector and consists of said support and a cover which can be attached to it.

Said device is a second cross-connection connector in which said insulative body is that of said second cross-connection connector, said front support means for guiding said wires is a rear part of said insulative body and an overall protective member fastens said rear block and said insulative body together and extends onto said sheathed cable.

BRIEF DESCRIPTION OF THE DRAWINGS

Features and advantages of the present invention emerge from the following description of embodiments of the connection device, which description is given with reference to the accompany drawings. In the drawings.

MORE DETAILED DESCRIPTION

Figure 1:
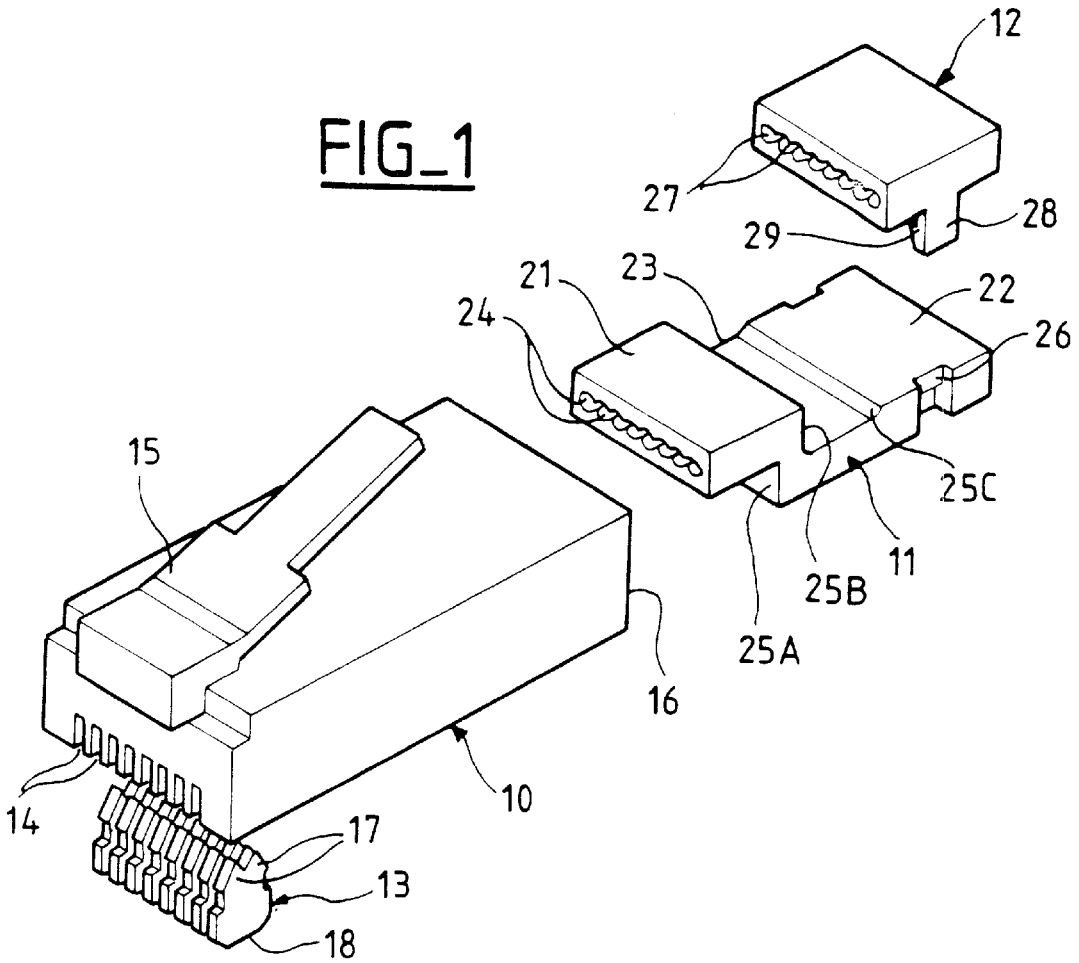
FIG. 1 is an exploded perspective view of a first type of connection device, which takes the form of a male RJ45 connector adapted in accordance with the invention.

The connection devices shown in the drawings are all for connecting multipair cables by means of a male RJ45 connector in accordance with the invention and a complementary standard female RJ45 connector, or a terminal strip adapted in accordance with the invention, or a cross-connection connector adapted in accordance with the invention and a standard terminal strip receiving the adapted cross-connection connector. The devices in accordance with the present invention are for transmission at high bit rates, from 100 Mbit/s to several Gbit/s, with improved performance in terms of crosstalk between pairs, conforming to category 5 and 6 transmission standards.

Figure 2:
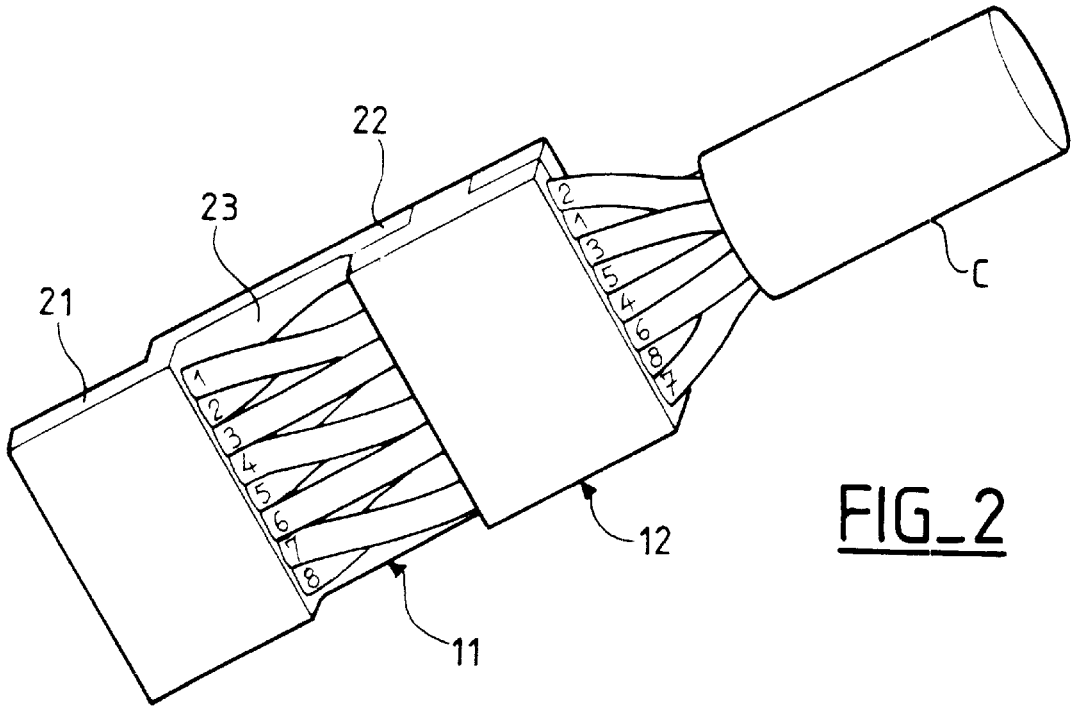
FIG. 2 is a partial perspective view of the connector from FIG. 1 fitted to a multipair cable.

Referring to FIGS. 1 and 2, the male RJ45 connector is designed for a cable C comprising four unscreened pairs. The insulated wires of the pairs are arranged in a row at the end of the connector. The insulated wires are numbered from 1 to 8 along the row. They are in a predefined order along the row to conform to the usual order of the points of connection to the corresponding pairs in a female RJ45 connector in order to limit coupling between the middle pairs in the row. The pairs of the cable C comprise the wires 1 and 2, 3 and 6, 4 and 5, and 7 and 8.

The connector incorporates the stripped end part of the cable and includes an insulative body 10, an insulative wiring support 11, an insulative coupling compensator block 12 and a set of eight contacts 13. The coupling compensator block 12 mounts directly on the insulated wires of the pairs of the cable and is removably fixed to the wiring support 11. The support and the block it carries are mounted in the insulative body 10, which surrounds them completely and extends over the cable C.

The insulative body is of a type known in the art. Slots 14 in its front face and one of its main faces receive the contacts 13 with the required pitch. A guide lug 15 clips resiliently into the female RJ45 connector. It is fastened to and extends freely away from the front portion of the main face. The rear end 16 of the body is open.

The contacts 13 are flat and of the type known in the art for male RJ45 connectors. Their first ends 17 received in the insulative body are sharp. Their opposite second ends 18 constitute the terminals of the male connector which are connected to those of the female connector.

The wiring support 11 has a front end part 21 for guiding the insulated wires in order to connect them to the contacts, a rear end part 22 for retaining the insulated wires to compensate coupling, and an intermediate part 23 between the two parts 21 and 22 and in which the insulated wires cross over. The front part 21 has a row of short parallel guide channels 24 at the same pitch as the contacts 13 in the slots 14. These channels are slotted at one end only for inserting the sharp ends of the contacts into them. They connect the wires and the contacts along a transverse path. The rear part 22 is for removably attaching the block to the support. A shoulder 25A on the bottom face of the support, between its front and intermediate parts, constitutes a stop defining the end of the insertion of the support into the insulative body, which itself carries a complementary interior shoulder that cannot be seen. The intermediate part is delimited by two shoulders 25B and 25C on the top face of the support. Two lateral notches 26 on the rear part with a shoulder at mid-height removably fasten the block 12 to the rear part 22.

The coupling compensator block 12 has a row of parallel channels 27 which are in lateral communication with one another along their length and therefore define a single peripherally closed passage for holding all the insulated wires pressed together in a layer. It grips this layer of wires at the shortest possible distance from the end of the sheath of the cable C. The channels 27 and therefore the block are very short. Two flexible lateral lugs 28 with teeth 29 on the inside retain the block by engaging in the shouldered notches of the wiring support.

The block 12 is preferably made in one piece. It can instead be made in two pieces which are placed one on the other and fastened together or formed partly on the rear part 22 and partly on a cap fastened to it.

Like the block 12, the intermediate part 23 of the support 11 is very short. Its length is preferably just sufficient to allow the wires to cross over and to hold them in position. The wires 1 to 8 of all of the pairs preferably cross over on the intermediate part and advantageously not more than two wires cross over each other. The wires which cross over are the wires 1 and 2, 4 and 5, and 7 and 8, as shown in FIG. 2. The order in which the wires enter the block is then 2, 1, 3, 5, 4, 6, 8 and 7. Alternatively, the wires 3 and 6 can cross over with the wires 3, 6 and 4 and the wires 3, 6 and 5 superposed. The order in which the wires enter the block is then 1, 2, 6, 4, 5, 3, 7 and 8.

The connector is very quick and easy to fit to the stripped end portion of the cable. The block 12 is first mounted on all the insulated wires, which are arranged in the order indicated above. The block is then slid towards the sheathed cable until there is a very short distance between the block and the end of the sheath of the cable. The insulated wires are then crossed over as indicated above and inserted into the guide channels 24. The block is either already fixed to the wiring support or fixed to it afterwards. The wires are tensioned, the wiring support is pushed against the sheathed cable and the excess lengths of wire are cut off. This completes assembly of the wiring support which is then mounted fully into the insulative body, which locates the block in the insulative body. The contacts are inserted into the slots 14 and enter the channels 24, and are therefore connected to the wires retained therein. This fastens the insulative body directly to the cable.

The insulative body is long enough to cover the end of the sheathed cable. It can of course be associated with a rear cap, which is either threaded onto the cable beforehand or made in two parts that can be fastened together, and is received on and fastened to the rear end of the insulative body, or with a rear finishing sleeve or molding between the insulative body and the sheathed cable.

Of course, the insulative body can be externally screened.

In the above connector, the lengthwise clamping in the block 12 of contiguous wires which belong to different pairs provides very rigorous, reliable and reproducible compensation of coupling between the pairs after the wires cross over. With a very short block, not more than 5 mm long, it provides the exact compensation required for the coupling between the pairs inside the male connector. The short length of the intermediate part 23 holds the various crossing over wires in a fixed position to achieve permanent compensation without requiring particular precautions when fitting the connector to the cable. The length of the intermediate part 23 can be less than 5 mm. The wiring support itself therefore has a short length, not more than 15 mm, so that it can be accommodated without difficulty in a standard male RJ45 connector body. The otherwise standard connector obtained in this way easily conforms to category 6 transmission standards when used with a complementary female connector with reduced compensation of coupling therein.

In a variant, not shown, relating to FIGS. 1 and 2, the four middle channels of the block are longer than the two lateral channels of the block and the four middle guide channels on the front part of the wiring support on the intermediate part are shorter than the lateral channels. The four middle channels of the block project relative to the ends of the lateral channels and the four middle channels of the front part of the wiring support are set back relative to the ends of the lateral channels. Other arrangements can be used. This enables the crossing point of the two middle wires to be shifted relative to the crossing point of the two end wires whilst maintaining fixed crossovers and obtains a greater degree of compensation of coupling between some of the pairs, preferably between the middle pairs, i.e. the pairs where the coupling is strongest.

As described with reference to FIGS. 3 and 4, the above wiring and coupling compensation arrangements according to the invention can be provided in an analogous manner on a standard terminal strip, to improve its transmission performance.

The terminal strip includes an insulative body 30 and two rows of insulation displacement contacts 32 which are mounted in the body, face each other in pairs in each row and are connected at the rear of the body. They are separated from one another in each row by insulative partitions 33. The terminal strip has at the front end and on each face a series of flat lugs 34. Slots 35 in line with the insulation displacement slots 36 of the contacts are delimited between these lugs.

In this embodiment, each row includes eight contacts. An incoming cable C has four pairs, made up of insulated wires 1 to 8, and is connected to the contacts of one of the rows with the pairs in succession along that row. Other subscriber line pairs of another cable or cables are connected directly, without coupling compensation, to the successive pairs of contacts of the other row and are therefore connected to the pairs of the cable C in the terminal strip.

The terminal strip can of course include a greater number of contacts in each row and be connected to a cable or cables of greater overall capacity than the aforementioned cable C. It can also include screens between the pairs of contacts of each of the two rows to reduce crosstalk between the successive pairs connected to subscriber lines. This is known in the art.

In the terminal strip adapted in accordance with the present invention, the insulative body 30, or to be more precise the part 31 of the body extending along the row of contacts connected to the pairs of the cable C, is used directly as a wiring support and retains at least one coupling compensator block 40.

The block 40 is advantageously assigned to four pairs of insulated wires, is similar to the block 12 shown in FIGS. 1 and 2, and is centered relative to the four pairs of contacts to which the four pairs of wires are connected. It clamps the insulated wires together near the end of the sheath of the cable C. It can differ from the block 12 only in that it can be slightly longer and/or in terms of how it is retained on the insulative body. It is therefore not described in more detail.

The part 31 of the insulative body 32, like that of the wiring support shown in FIGS. 1 and 2, defines a front part 41 for guiding the wires 1 to 8, which are parallel to each other, at the same pitch as the contacts and transverse to the contacts, a rear part 42 inboard of the rear end of the terminal strip for retaining the block 40, and an intermediate part 43 in which the wires cross over. These parts are short. The front guide part 41 is defined by the bottom of the slots 35, which constitute paths for the insulated wires, which are bent at this level and connected transversely to the contacts 32. Two aligned passages 46 through the rear part 42 receive lateral fixing lugs 48 on the block 40 to hold it in position relative to the front part 41, enabling the wires to cross over on the intermediate part 43.

The two wires of the same pair cross over on this intermediate part, the pairs being treated differently between the block and the contacts to which they are connected according to their relative position and their length. An even number of crossovers (0 or 2 crossovers) is used for the even-numbered pairs from one end of the layer of wires leaving the block 40 and an odd number of crossovers (1 or 3 crossovers) is used for the odd-numbered pairs. As shown by way of example, the wires 1 and 2 cross over once, the wires 3 and 4 do not cross over, the wires 5 and 6 cross over once and the wires 7 and 8 do not cross over. As an alternative to this, the end wires 1 and 2 can cross over three times and the end wires 7 and 2 twice, to allow for the fact that these wires are left longer than the wires of the middle pairs and to assure greater twisting of the wires of the end pairs, to obtain a better grip on the crossovers to hold them fixed in place and improved control of coupling compensation.

Experiments conducted by the applicant show the benefit of adapting the terminal strips in accordance with the invention. By virtue of these adaptations, a terminal strip which previously conformed to the category transmission standards conforms to the category 5+ standards. Likewise, a terminal strip that in the usual form conforms to the category 5+ standards conforms to the category 6 standards when adapted in accordance with the invention.

Figure 4:
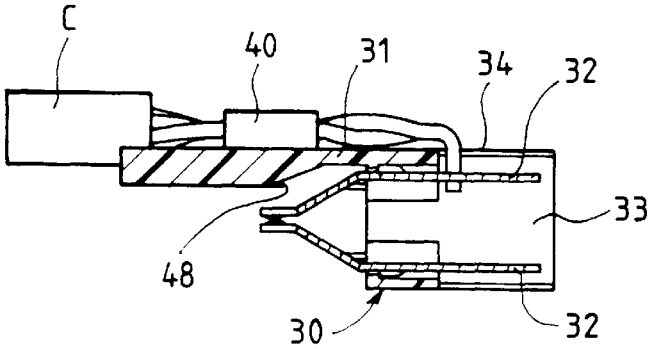
FIG. 4 is a sectional view of the terminal strip shown in FIG. 3.
Figure 5:
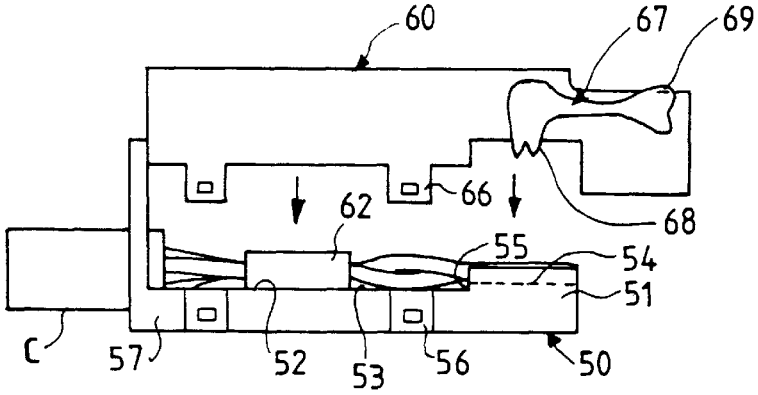
FIG. 5 is an exploded view of a third type of connection device, which takes the form of a cross-connection connector adapted in accordance with the present invention.

The connector shown in FIG. 5 is used to connect a multipair cable C removably to a standard terminal strip which generally has a greater number of contacts in each row. The cable C equipped in this way then constitutes a connection and cross-connection cord. The connector represents a variant of the fixed connection of the pairs of the cable C in a terminal strip of the type shown in FIGS. 3 and 4. It plugs into the terminal strip, between the two rows of contacts, and connects the insulated wires of the pairs of the cable C to the same number of successive contacts of one of the two rows of contacts of the terminal strip, and thereby to other pairs of wires connected in fixed manner to the other row of contacts of the terminal strip.

According to the invention, this cross-connection connector is equipped with wiring and coupling compensation means, but the terminal strip is not, and is constructed and used as in the past.

The cross-connection connector includes a wiring support/coupling compensator 50 and a cover 60 which can be fastened to the support, so defining the connector body.

Figure 3:
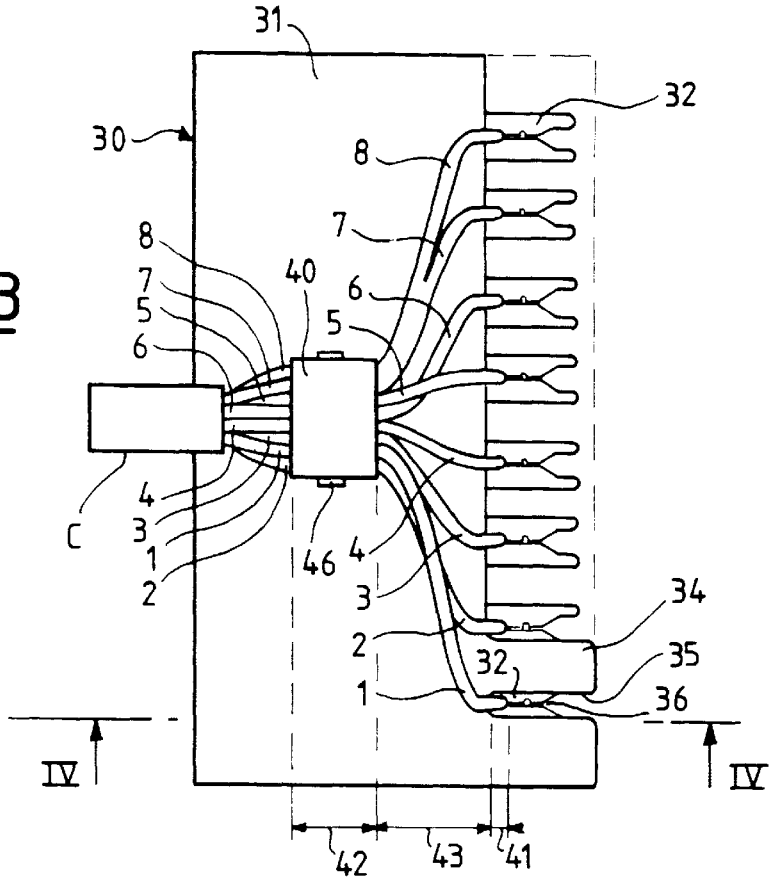
FIG. 3 is a partly cutaway elevation view of a second type of connection device, which takes the form of a terminal strip adapted in accordance with the invention.

The support 50 has a front end part 51, a rear part 52 inboard of the rear end of the connector, and an intermediate part 53 which are similar to the corresponding parts 41, 42 and 43 on the part 31 of the insulative body 30 of the terminal strip shown in FIGS. 3 and 4 and the corresponding parts of the support 10 shown in FIG. 1. The front part 51 has a row of parallel channels 54 for guiding the insulated wires of the pairs of the cable C at the same pitch as the contacts to which they are to be connected. The insulated wires cross over on the intermediate part 53 in the same fashion as indicated for the intermediate part 43 of the terminal strip shown in FIGS. 3 and 4. There is a shoulder 55 between the intermediate and front parts. The rear part 52 retains a coupling compensator block 62.

The rear part 52 is extended by a right-angled rear end flange 57 through which the sheathed cable passes and which receives the insulated wires freed from the sheath of the stripped cable from below and just ahead of the block.

Lateral notches, for example the notch 56, are provided on the wiring support 50 to retain the cover 60.

The block 62 is similar to the block 40 of the terminal strip shown in FIGS. 3 and 4, which is in turn similar to the block 12 of the connector shown in FIGS. 1 and 2. It is therefore not described further. The lateral lugs for clipping the block 62 to the support 50 can be dispensed with and the block held in place by the cover 60 fitted to the support.

The cover 60 is fitted to the support 50 to cap and close it lengthwise. Lugs 66 received in the lateral notches 56 hold it in place. It carries a row of contacts 67 retained in a front part of the cover and in line with the channels 54. The contacts 67 each have a sharp end 68 which projects internally from the cover and is in line with one of the insulated wires in the channels 54 in order to be connected to it in the transverse direction. They each have another end 69 which projects slightly out of the cover to connect them to one of a row of contacts of the terminal strip receiving the connector. Of course, these contacts can have an insulation displacement end rather than a sharp pointed end, in which case the channels 54 are slotted transversely to enable connection of the insulation displacement contacts transversely to the wires.

The connector improves the performance of the terminal strip into which it is plugged by reducing coupling between the pairs of the cable C connected to other pairs in the terminal strip and thereby achieves a performance comparable to that of the adapted terminal strips shown in FIGS. 3 and 4.

Of course, coupling between pairs can be compensated on the terminal strip and in the connector which plugs into it, although this is in itself less advantageous than the forms of compensation shown in FIGS. 3 and 4 and in FIG. 5, and necessarily achieves less coupling compensation than the terminal strip alone or the connector alone.

Figure 6:
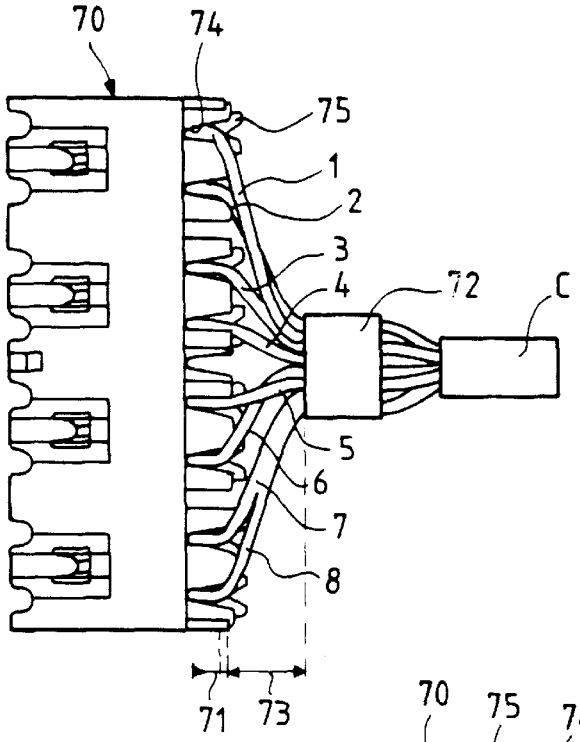
FIG. 6 is a view of a different embodiment of the cross-connection connector shown in FIG. 5.
Figure 7:
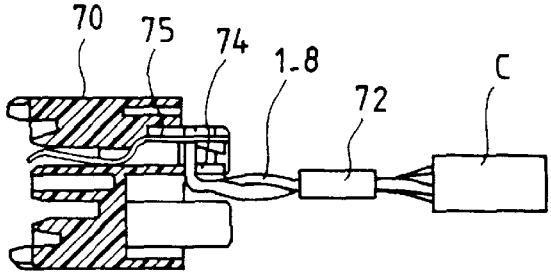
FIG. 7 is a sectional view of the cross-connection connector shown in FIG. 6.
Figure 8:
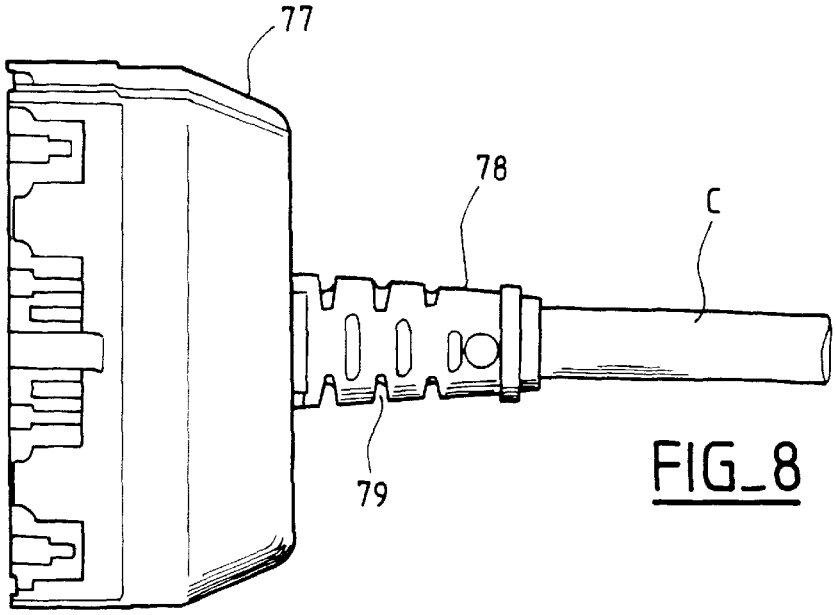
FIG. 8 shows the cross-connection connector shown in FIGS. 6 and 7 when completely assembled.

The embodiment of the cross-connection connector shown in FIGS. 6 to 8 is a connector of a type that is known in the art but which has been adapted in accordance with the present invention.

It has an insulative body 70 in which a row of eight contacts 75 is mounted. The front face of the connector plugs into a conventional terminal strip by resilient connection of its contacts 75 to eight successive contacts of one of the two rows of contacts in the terminal strip. Polarizer means are provided on the front face of the insulative body.

The contacts 75 of the connector have an insulation displacement rear end connected to one of the insulated wires 1 to 8 of the pairs of a multipair cable C. The arrangements in accordance with the invention for compensating coupling between pairs are used on these wires.

The connector therefore includes a rear block 72, similar to the block 52 shown in FIG. 5 or the block 12 shown in FIG. 1, for gripping the wires 1 to 8 tightly together in a layer and near the end of the cable, a front part 71 in front of the block for guiding the insulated wires for their transverse connection to the insulation displacement contacts 75, and an intermediate part 73 in which the wires cross over.

The front part 71 has slots 74 in line with the rear insulation displacement ends of the contacts 75. It is part of the insulative body, which has a series of fins substantially in the middle of its rear face, delimiting the slots 74 in line with the rear ends of the contacts. The insulated wires, bent against the bottom of these slots, are connected to the contacts 75.

The insulated wires cross over in the intermediate part in a similar way to how the wires cross over on the terminal strip shown in FIG. 3.

The cross-connection connector further includes a protective hood 77 which also holds the block 72 in position relative to the insulative body and therefore relative to the contacts therein and relative to the sheathed cable C. The hood 77 is advantageously molded over the insulative body and the sheathed cable, with the block and the crossing over wires embedded in it so that their position cannot vary. It forms a transition 78 between the insulative body and the sheathed cable, with peripheral grooves 79 to make it flexible.

A variant, not shown, of the cross-connection connector shown in FIGS. 6 to 8 has the insulated wires soldered to the contacts. This being the case, the rear face of the insulative body, onto which the rear part of the contacts open, guides the insulated wires for connecting them transversely to the contacts, and can advantageously have transverse striations to provide this guidance.

The cross-connection connector shown in FIGS. 6 to 8, or this latter variant of it, when connected to a standard terminal strip, achieves performance similar to that of the terminal strip shown in FIGS. 3 and 4.

What is claimed is:

1. A low crosstalk connection device for a multipair cable, the device comprising a stripped end part of said cable, an insulative body, a row of first contacts mounted in said body, rear support means along said stripped end part of said cable including a row of parallel channels of particular length for retaining insulated wires of said pairs, front support means for guiding said wires, at the same pitch as said contacts and in a particular order different from that of said wires in said channels, for connecting said wires to said first contacts, and an intermediate part in which the insulated wires of said pairs cross over, wherein said channels are in lateral communication with one another along their length and define a peripherally closed passage for tightly gripping all of said insulated wires in contact with one another in a layer, near the end of the sheath of said cable, wherein said front support means include a path for transversely connecting said wires to said first contacts, and wherein said rear support means comprises a block through which said channels pass and which is held in position relative to said front support means.

2. A device according to claim 1, wherein said intermediate part between said front and rear parts for holding the crossing over wires fixed in position thereon is of limited length.

3. A device according to claim 1, wherein said channels are less than 5 mm long.

4. A device according to claim 1, wherein said intermediate part is less than 5 mm long.

5. A device according to claim 1, wherein said front part is less than 5 mm long.

6. A device according to claim 1, including a support equipped with said block and integrating said intermediate part and said front support means.

7. A device according to claim 6, constituting a male RJ45 connector, said insulative body is that of said connector and said support is mounted in said insulative body.

8. A device according to claim 6, constituting a terminal strip, said insulative body is that of said terminal strip, is equipped internally with another row of second contacts, each of which faces one of said first contacts and is connected thereto inside the terminal strip, and defines directly said support extending along the row of first contacts.

9. A device according to claim 6, constituting a cross-connection connector that can be plugged into a terminal strip and said insulative body is that of said cross-connection connector and is defined by said support and a cover which can be attached to it.

10. A device according to claim 9, wherein the row of first contacts is mounted in said cover in line with said front support means of said support and said first contacts have a first end inside said body and connected transversely to one of said wires and a second end outside said body and connected to a terminal strip by plugging said cross-connection connector into it.

11. A device according to claim 1, wherein said insulative body is that of said cross-connection connector and defines said front guide support means in line with a rear end of each of said first contacts and said device constitutes a cross-connection connector that plugs into a terminal strip and includes an overall protective member holding said insulative body and said block in position and fastening them together.

12. A device according to claim 11, wherein said protective member includes a flexible transition extending over the sheathed cable.

13. A device according to claim 12, wherein said protective member is a molding.

* * * * *